US006053428A

United States Patent [19]

Van Der Steur

[11] Patent Number: 6,053,428

[45] Date of Patent: Apr. 25, 2000

[54] ROTARY ATOMIZER WITH INTEGRATED SHAPING AIR

[76] Inventor: Gunnar Van Der Steur, 3415 McCommons Rd., Churchville, Md. 21078

[21] Appl. No.: 09/090,880

[22] Filed: Jun. 5, 1998

Related U.S. Application Data

[60] Provisional application No. 60/066,757, Nov. 21, 1997.

[51] Int. Cl.[7] ..... B05B 1/28

[52] U.S. Cl. ..... 239/290; 239/112; 239/223

[58] Field of Search ..... 239/290–293, 239/298–301, 700–703, 112, 223

[56] References Cited

U.S. PATENT DOCUMENTS

| | | | |
|---|---|---|---|
| 2,159,400 | 5/1939 | Preston | 299/63 |
| 2,220,275 | 11/1940 | Preston | 299/63 |
| 2,976,175 | 3/1961 | Reindl | 239/700 |
| 3,043,521 | 7/1962 | Wampler | 239/223 |
| 3,057,558 | 10/1962 | Verba et al. | 239/700 |
| 3,067,949 | 12/1962 | Sigvardsson et al. | 239/700 |
| 3,700,168 | 10/1972 | Ferrant | 239/3 |
| 4,148,932 | 4/1979 | Tada et al. | 427/31 |
| 4,458,844 | 7/1984 | Mitsui | 239/703 |
| 4,518,119 | 5/1985 | Vetter | 239/703 |
| 4,605,168 | 8/1986 | Tachi et al. | 239/112 |
| 4,784,332 | 11/1988 | Takeuchi et al. | 239/703 |
| 5,106,025 | 4/1992 | Giroux et al. | 239/703 |
| 5,183,210 | 2/1993 | Takeishi et al. | 239/301 |
| 5,894,993 | 4/1999 | Takayama et al. | 239/112 |

FOREIGN PATENT DOCUMENTS

| | | |
|---|---|---|
| 1263775 | 5/1961 | France . |
| 1363681 | 5/1964 | France . |
| 846181 | 8/1960 | United Kingdom . |

*Primary Examiner*—Andres Kashnikow
*Assistant Examiner*—Dinh Q. Nguyen
*Attorney, Agent, or Firm*—Foley & Lardner

[57] ABSTRACT

A rotary atomizer has shaping members to generate shaping air without the need for independent sources of shaping air. The distribution and shape of the shaping members and the selection of rotating speed allows for the selection of virtually any pattern of distribution of atomized material. The shaping members are positioned to produce an outward flow of air from the rotary atomizer thereby eliminating the need for external sources of shaping air.

20 Claims, 4 Drawing Sheets

ROTARY ATOMIZER WITH INTEGRATED SHAPING AIR

This application claims benefit of provisional application No. 60/066,757 Nov. 21, 1997.

BACKGROUND OF THE INVENTION

1. Field of the Invention

The invention relates generally to methods and apparatus for applying coatings. In particular, the invention relates to rotary atomizers which atomize material to be applied as a coating. Further, in particular, the invention relates to a rotary atomizer which reduces or eliminates the need for external shaping air to direct atomized material to an object to be coated. The coating material can be, for example, a liquid or powder.

2. Related Art

The use of rotary spray atomizers to apply coatings to an object is well known. One such application of rotary spray atomizers to coat objects is the application of paint and other coatings to newly manufactured automobiles.

FIG. 1 herein illustrates a conventional rotary atomizer, such as bell cup 101 attached to turbine 103. Such rotary atomizers typically have a smooth exterior surface. Typically, a shaft in the turbine (not shown) causes the bell cup to rotate at a desired speed. Material to be atomized, such as paint, is supplied to the bell cup as it rotates. The paint or other material to be atomized travels along the interior of the bell cup and exits the bell cup 101 through a single opening or a plurality of openings 105 on the face of bell cup. In order to control the shape of the distribution of atomized material, shaping air is transmitted through outlets 107 of turbine 103. The shaping air is typically supplied from an independent source to achieve the fan shaped pattern of atomized product distribution shown generally at 109 in FIG. 1. Essentially, the shaping air directs the atomized material outward and away from the bell cup 101 to prevent too wide a distribution of the material as shown by dotted lines 111. One characteristic of this type rotary atomizer is the presence of a "pancake" of atomized material 113. The pancake of atomized material creates imperfections in the application of the atomized material as a coating, such as in painting applications.

Notwithstanding the use of independent shaping air to direct atomized materials such as paint away from bell cup 101, "blow back" of such material is always a problem. Various apparatus such as a shaping air plate or a shaping air shroud have been used to reduce blow back. However, when external shaping air is used, some of the atomized coating material inevitably travels behind the rotary atomizer or bell cup thereby coating the rotary atomizer, the turbine housing and any other robotic components attached to them. The blow back of coating material onto the rotary atomizer bell cup, turbine housing and other components results in increased maintenance, since such components require constant cleaning. In addition, blow back of coating material toward the turbine decreases the life expectancy of the turbine and lowers coating efficiency and performance.

SUMMARY AND OBJECTS OF THE INVENTION

It is an object of the invention to provide a rotary atomizer that significantly reduces or eliminates the deficiencies of conventional rotary atomizers using an independent source of shaping air.

It is still another object of the invention to provide a rotary atomizer which generates its own shaping air without the need for an independent source of shaping air.

The above and other objects of the invention are accomplished by a rotary atomizer which includes a rotating member having an inlet side to receive material for atomization and an outlet side for outputting the atomized material. The atomizer also includes a plurality of shaping members on an exterior portion thereof. The shaping members can be channels on an exterior surface of the rotating member or blades, fins or other vanes. As the rotating member rotates, shaping air that is required to overcome centrifugal forces on the coating material leaving the outer edges of the bell cup is produced by air passing through the channels or the blades. This self-generated shaping air drives the atomized material, such as a coating material, in the desired direction. For example, atomized paint is directed toward the surface of the object being coated using shaping air generated by the rotary atomizer without the need for an independent source of shaping air.

BRIEF DESCRIPTION OF THE DRAWINGS

The above and other objects of the invention are accomplished by a rotary atomizer as described herein in conjunction with the drawings in which.

DETAILED DESCRIPTION OF THE PREFERRED EMBODIMENTS

Figure 2:
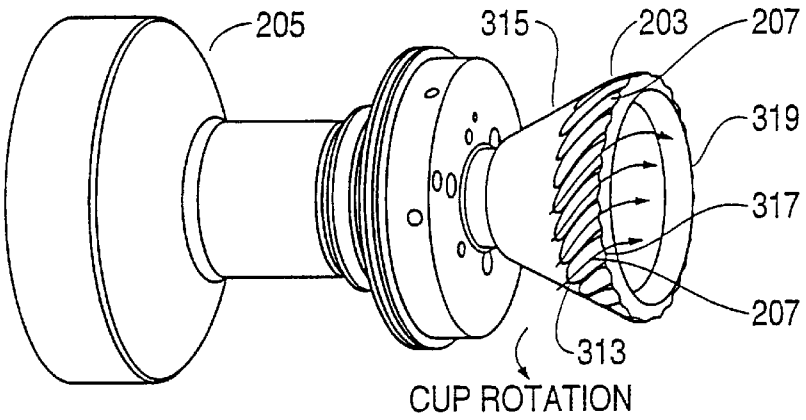
FIG. 2 shows one embodiment of a rotating atomizer according to the invention attached to a turbine.

In FIG. 2, one embodiment of a turbine and rotary atomizer assembly is shown generally at 201. A rotating member 203 is attached to the turbine assembly 205. As shown in FIG. 2, the rotating member 203 is a generally bell-shaped cup. Bell-shaped cup 203 in FIG. 2 is by way of example and not limitation, since any shape rotating member can be used in accordance with the invention.

Conventional rotary atomizers have a smooth exterior surface. A distinctive feature of the rotary atomizer 203 according to the invention is the existence of one or more shaping members 207 on an exterior surface of the rotating member 203. As illustrated further herein, the shaping members 207 are channels or indentations formed in the exterior surface of the rotating atomizer bell cup. The use of indentations in the exterior surface of the rotary atomizer bell cup to form the shaping channels is by way of example and not limitation. For example, in another embodiment the shaping members can be formed using raised members such as blades, fins or vanes which extend outward from the exterior surface of the rotary atomizer bell cup. For purposes of illustration herein, the invention will be further explained using channels as an illustration, but it will be understood that shaping members can be formed employing the same principles using blades, fins or vanes.

Figure 3B:
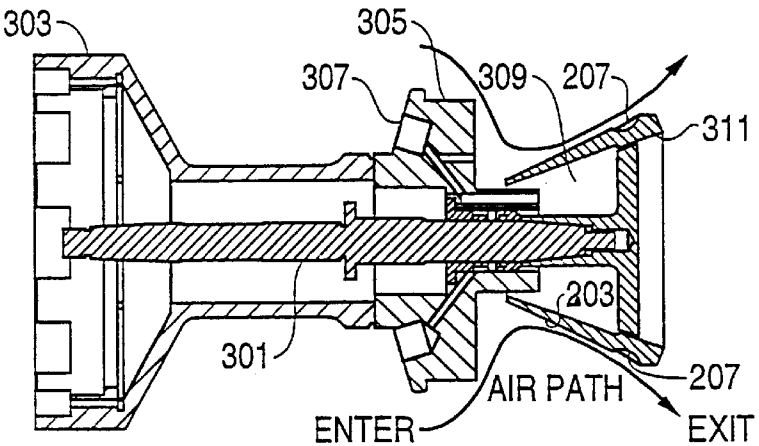
FIGS. 3*a* and 3*b* are front and sectional views respectively of the rotating atomizer and turbine shown in FIG. 2.
Figure 3A:
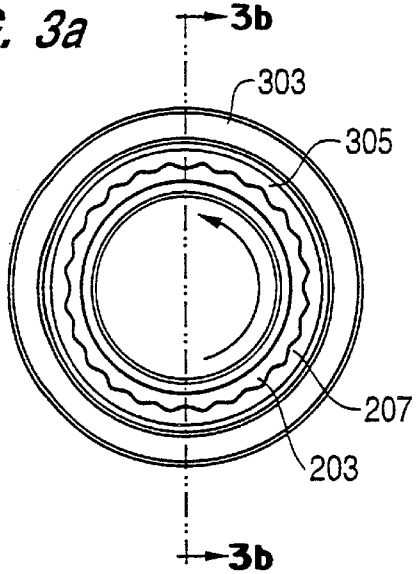

FIGS. 3*a* and 3*b* show a front view and a cross-section, taken along line 3*b*—3*b* of FIG. 3*a* respectively, of the assembly shown in FIG. 2. Rotary atomizer bell cup 203 having channels 207 rotates with rotation of a shaft member 301 driven by a motor (not shown) in turbine motor housing 303. An injection manifold, such as paint injection manifold 305, is connected at inlet 307 to a supply of material, such as paint, to be atomized. Paint supplied to injection manifold 307 is routed to an inlet portion 309 of rotary atomizer bell cup 203. The paint or other material to be atomized travels through the inlet section, is atomized in the rotary atomizer bell cup and exits cup 203 as atomized material through outlets 311. Typically outlets 311 are a series of holes at an outlet side of the rotating atomizer or bell cup.

An important feature of the invention is the elimination or reduction of the need for an independent source of shaping air. As a result of the presence of shaping members 207, such as channels or vanes on the exterior surface of the rotary atomizer, such as bell cup 203, the rotary atomizer generates its own shaping air. The exact pattern of distribution of atomized material depends, for example, on the geometry of the shaping members 207, the number and location of the shaping members and the speed of rotation. Experimental results suggest that the pattern of distribution of atomized material is narrowed as the volume of shaping air increases. FIGS. 2 and 3*b* show that as a rotating atomizer such as bell cup 203 rotates, ambient air passes along the exterior surface of the rotating member and enters channels 207 from a rear portion 313 of the channel closest to rear portion 315 of rotating member 203. Ambient air exits channel 207 at a front portion 317 which is on a front edge 319 of rotary atomizer 203. The self generated shaping air exiting front portion 317 of channels 207 directs the distribution of atomized material.

Figure 4:
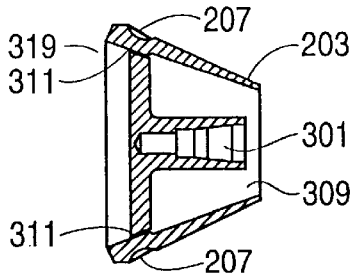
FIG. 4 is a cross-sectional of a rotating atomizer according to the invention.

FIG. 4 is a sectional view of rotating member 203 and illustrates one possible geometry for shaping member 207. As shown in FIG. 4, shaping member 207 is a channel cut in the exterior surface of rotary atomizer 203. With a substantially smooth curve the channel has a generally "U" shape. However, channels can also be formed with edges forming squares or rectangles or in a "V" shape. Other more complicated channel shapes are also within the scope of the invention.

Figure 5:
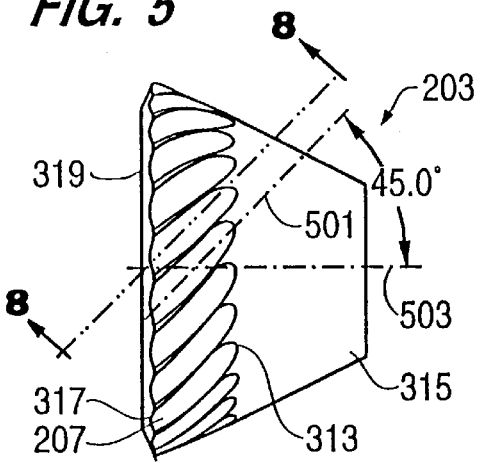
FIG. 5 is a side view of a rotating atomizer according to the invention.

FIG. 5 is a side exterior view of rotary atomizer bell cup 203 illustrating one embodiment of the invention in which the shaping members 207 are placed next to each other on an exterior of rotary atomizer 203. Shaping members 207 can be placed directly next to each other as shown in FIG. 5 or can be spaced apart from each other to create different patterns of distribution of atomized material. The angle at which the shaping member is placed in the exterior surface of the rotary atomizer can also affect the pattern of distribution of atomized material. As previously noted, the effect of the shaping members is to generate shaping air from the ambient air. The shaping air is directed outward from the edge 319 of rotary atomizer 203 in a fan like pattern.

As previously noted experimental results suggest that the shape of the pattern is a function of the volume of air moved, with a narrower pattern resulting as the amount of air moved increases. Thus, for a particular set of shaping members on a rotary atomizer, the fan pattern or distribution of atomized material would be expected to narrow as the speed of rotation increases. The fan pattern can also be affected by the geometry of the shaping air members, whether they are channels or blades.

A pitch angle can be defined as an angle measured from the centerline 501 of channel 207 to the centerline 503 of rotary atomizer 203. A positive pitch angle can be defined in which the rear portion 313 of the channel 207 is offset from the front portion 317 of the channel 207 in a direction to cause a flow of shaping air outward from the front edge 319 of rotating member 203. Thus, in the case where the rotating member 203 rotates in a counterclockwise direction as viewed from the front, a positive pitch angle has the rear portion 313 of the shaping member offset to the left of the front portion 317 of the shaping member, thereby creating an outward flow of air to generate a fan to control the distribution of atomized material. A negative pitch angle has the opposite effect, thereby tending to reverse the flow of shaping air toward the rotating member. Where the rotating member rotates in a counterclockwise direction, a negative pitch angle has the rear portion 313 of the shaping member to the right of front portion 317 of the shaping member as viewed from the front of the rotating member 203. Where the rotation of the rotating member is in a clockwise direction, the positive and negative pitch angles are reversed.

In addition to the spacing of shaping members 207, the number of spacing members also can be selected to achieve the desired pattern of distribution of atomized material. Thus, the shape of the distribution is effected by the number of shaping members 207 on the exterior of rotary atomizer 203, the relative spacing of shaping members 207, the depth of the shaping member 207, the width of the shaping member 207 (the width of the top of the channel and at its bottom may be different), the interior shape of the shaping member 207 and the relative pitch angle as measured from a center axis from the front edge of the rotary atomizer. In addition, the length of the shaping member from the front of the shaping member 317 to the rear of the shaping member 313 can also be selected to influence the pattern of distribution of atomized material.

Figure 6:
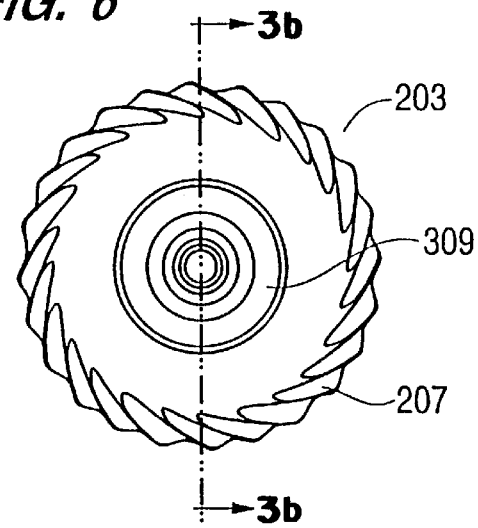
FIG. 6 is a rear view of a rotating atomizer according to the invention.
Figure 7:
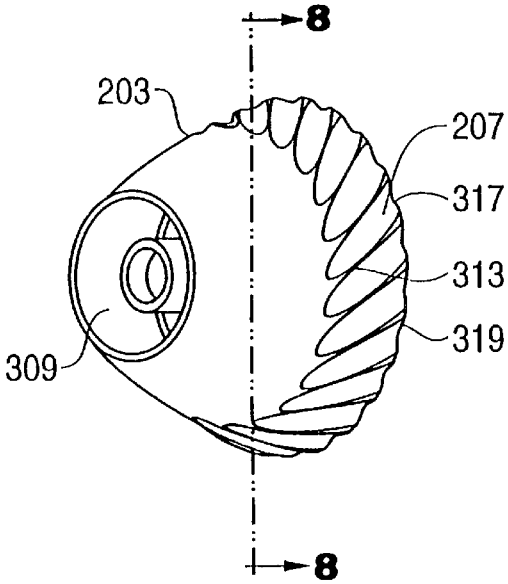
FIG. 7 is a rear perspective view of a rotating atomizer according to the invention.
Figure 8:
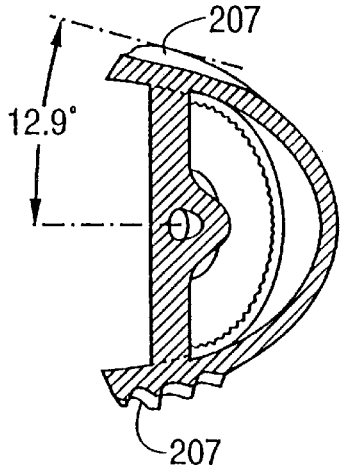
FIG. 8 is a cross-section of a rotating atomizer along line 8—8 in FIGS. 5 and 7.

FIG. 6 is a rear view of rotary atomizer bell cup 203 showing the relative position of shaping members 207. FIG. 7 is a rear perspective view of rotating atomizer bell cup 203 and FIG. 8 is a view along section 8—8 of FIGS. 5 and 7. FIG. 8 illustrates that the depth of the shaping member 207 can be selected. Another parameter of the shaping member which can be selected is its slope, defined as a change in the depth of the shaping member. For example, shaping member 207 can be deeper at edge 317 where shaping air exits and a shallower at edge 313 where shaping air enters. The opposite slope might also be used and the slope could vary along the length of the shaping member to achieve a desired shaping air pattern. As previously indicated, the shaping members can be indentations or channels as shown in these drawings or can be raised blades, or fins or vanes on the exterior surface of the rotating atomizer 203. The invention applies to any rotatable element such as the generally bell-shaped cup shown herein or a flat-sided cup or a plate or shaft or any other type of rotating atomizer or device. Blades or fins can be used in place of the indented channels as shown herein. A rotary atomizer according to the invention can be used to distribute any kind of material to be atomized, such as a powder or a liquid paint or solvent. A typical application would include the spray application of paint or other coatings.

As previously discussed, for a particular configuration of a rotating atomizer having such shaping members, the distribution of atomized material appears to vary with the turbine speed. Thus, different fan patterns can be achieved using different speeds of rotation. For example, where a primer coat requires one distribution pattern and a finish coat requires a different distribution pattern, the different patterns can be obtained with the same rotating member by changing the speed of rotation. Where the turbine speed is governed by other considerations, the rotating member can be formed with shaping members which produce the desired pattern at the desired rotating speed. As previously indicated, the desired pattern is influenced by the selection of the pitch, slope, depth, length, width, shape, and the number of shaping members and their relative positions on the exterior of the rotating member. An atomizer with shaping members as disclosed herein can be substituted in any application where independent shaping air is used.

Figure 1:
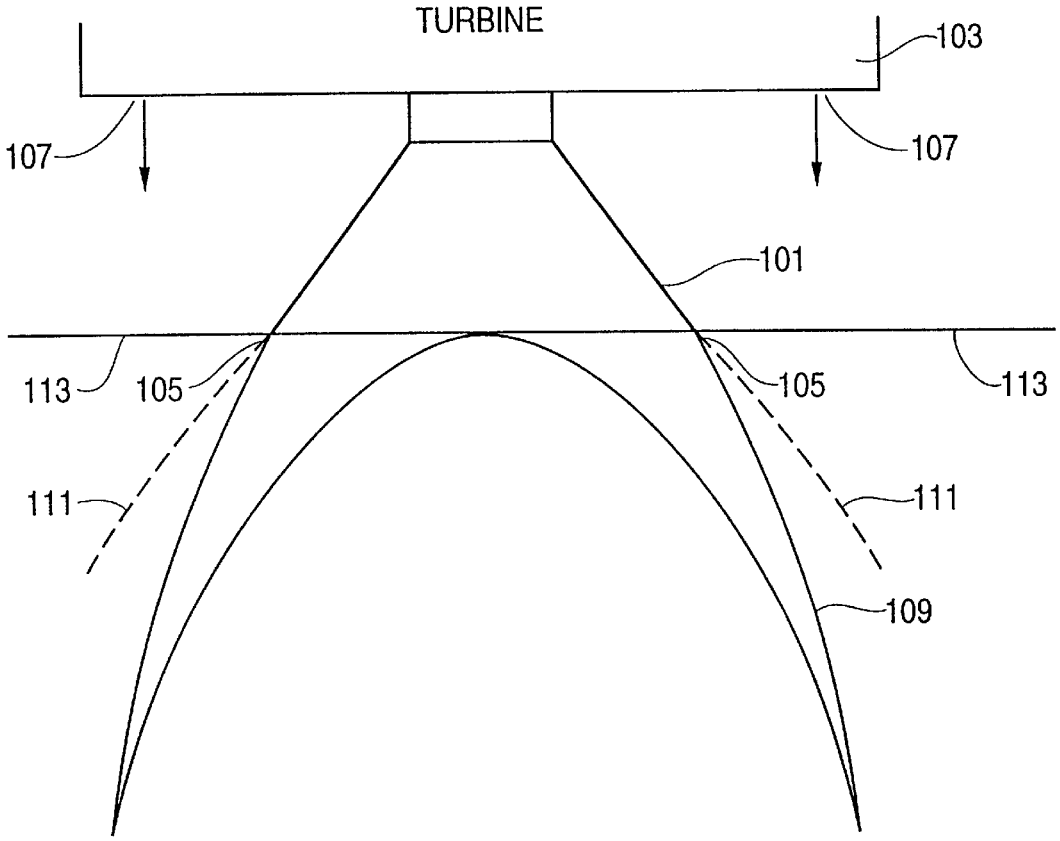
FIG. 1 illustrates a pattern of distribution of atomized material using a conventional rotary atomizer.

As described previously herein, conventional rotary atomizers tend to develop the "pancake" effect illustrated in FIG. 1 herein. Coating particles falling from the pancake tend to introduce imperfections in finished coatings. As coating material leaves the rotary atomizer such as the bell cup, larger particles tend to separate from the smaller particles. In order to achieve a uniform coating these larger and smaller particles need to be mixed completely. The atomizer according to the invention generates sufficient forward moving air to keep coating material moving in the direction toward the object to be coated. This also tends to create a "swirl effect" within the shaping air/coating material cone. The swirl effect created by the vanes or channels helps to mix the particles of different size producing a more uniform coating finish.

Electrostatic techniques have been used to apply coatings such as paint on large flat surfaces. In electrostatic paint techniques, the paint and the object to be coated are oppositely charged in order to cause the paint to be attracted to the object. One reason for the introduction of electrostatic paint techniques is the existence of the pancake of coating material produced by the atomizer and the need to attract the coating material out of the pancake. The self-generated forward moving air produced by the shaping members on the exterior of the rotating member according to the invention significantly reduces or eliminates the pancake, thereby improving paint transfer efficiency and reducing the amount of volatile organic chemicals present. The reduction in volatile organic chemicals reduces risks and improves safety.

The reduction or elimination of the pancake may also improve the coating performance in paint booths which employ downdrafts. In some manufacturing facilities, a large surface to be sprayed with a coating is placed inside a paint booth and a downdraft in the booth is used to pull the overspray from the pancake toward the object to be painted. The reduction or elimination of the pancake in the present invention reduces overspray, thereby improving the efficiency of paint transfer in the downdraft and making it easier to control. As a result, the invention reduces coating imperfections and produces a more uniform finish.

In applications where electrostatics are employed, the larger surface area resulting from the shaping members allows the rotating member to accumulate more charge thereby improving transfer efficiency. In essence, the increased surface area of the rotating member makes the rotating member appear larger, thereby accumulating more charge on its surface. It should be noted that in electrostatic paint applications, the top edge of the shaping member is preferably not sharp in order to reduce the possibility of corona which could lead to undesired arcing. In addition, it is recommended that the shaping members not have sharp edges so that they can be more conveniently handled by personnel without the risk of injury.

The self-generation of a sufficient volume of air by the shaping members to direct the distribution of material outward and away from the rotating member reduces the amount of blow back when compared to conventional systems using independent sources of shaping air. Reduced blow back reduces the amount of paint that accumulates on the turbine and increases turbine life. This effect further reduces the need for complicated "air seals" to protect the turbine from damage from material blown back toward it.

The self generation of shaping air achieved according to the invention reduces the need for compressed air, which conventional systems use to provide shaping air. This reduction in the need for compressed air improved energy efficiency and reduces cost.

Figure 9:
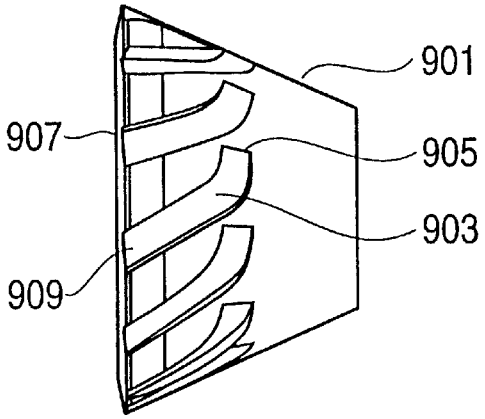
FIG. 9 illustrates an alternative embodiment according to the invention.
Figure 10:
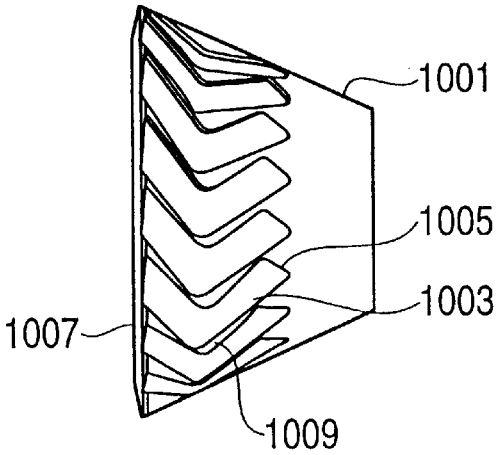
FIG. 10 illustrates another alternative embodiment according to the invention.

FIGS. 9 and 10 illustrate two alternative configurations of shaping members in a rotating member. In FIG. 9, rotating member 901 has shaping members 903. As member 901 rotates, ambient air enters shaping members 903 at rear portion 905. Rear portion 905 is at an angle of almost 90° to the face 907 of the rotating member. This allows for the maximum amount of air to enter the shaping member. Air travels through the shaping member and exits at front portion 909. Front portion 909 is shown having an exit angle which affects the pattern of distribution atomized material. The distribution pattern appears to widen as the angle increases. Shaping members 903 have a smooth transition between entrance 905 and exit 909.

FIG. 10 shows a rotating member 1001 with shaping members 1003. Air enters shaping members 1003 at entrance 1005 and exits at 1007. Shaping members 1003 are characterized by a sharp transition 1009. The sharp transition allows for reversal of the swirl direction and creates drag which slows down the shaping air. Other patterns including zig zag patterns of shaping members can be formed in the rotating member in order to achieve the desired effects.

Figure 11:
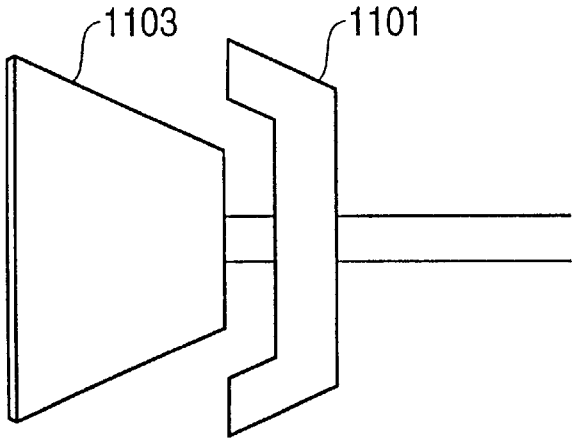
FIG. 11 illustrates still another embodiment according to the invention.

FIG. 11 illustrates still another configuration according to the invention. In FIG. 11 vanes or blades 1101 are located relative to a conventional rotary atomizer, such that a flow of shaping air is generated when the rotary atomizer rotates. In the example shown in FIG. 11, vanes 1101 are positioned behind a conventional atomizer, such as bell cup 1103. Vanes 1101 can rotate independently of atomizer 1103 or can rotate synchronously with atomizer 1103. Vanes 1101 may also remain stationary as the rotary atomizer turns. Vanes 1101 are shaped to direct air outward from atomizer 1103, as the atomizer rotates.

In addition, on any rotary atomizer combinations of positive and negative pitch shaping members can be used and the parameters previously discussed herein can be varied to achieve the desired distribution of atomized material.

Other embodiments of the invention will be apparent to those skilled in the art from consideration of the specification and practice of the invention disclosed herein. It is intended that the specification be considered as exemplary only, with the true scope and spirit of the invention being indicated by the following claims.

What is claimed is:

1. A rotary atomizer comprising:

a rotatable member having an inlet side adapted to receive material to be atomized and an outlet side adapted to output the material to be atomized; and a plurality of air shaping members on an exterior portion of said rotating member, wherein said shaping members comprise channels on an exterior surface of said rotatable member, said channels extending from a front edge of said rotatable member toward a rear of said rotating member, and wherein a rear portion of at least one of said channels is offset from a front portion thereof, said front portion being located at said front edge of said rotatable member.

2. A rotary atomizer as recited in claim 1, said rear portion being offset from said front portion in a direction producing a flow of shaping air outward from a face of said rotatable member.

3. A rotary atomizer as recited in claim 1, said front portion being disposed at an entrance angle and said rear portion being disposed at an exit angle different from said entrance angle.

4. A rotary atomizer as recited in claim 3, said entrance angle and at least one of said channels having a positive pitch.

5. A rotary atomizer as recited in claim 1, wherein said rotatable member comprises a bell cup.

6. A rotary atomizer as recited in claim 1, further including a rotating shaft attached to said rotatable member.

7. A rotary atomizer as recited in claim 1, wherein said channels have at least one of a depth, width, shape and pitch selected to produce a desired distribution of said atomized material.

8. A rotary atomizer as recited in claim 7, each of said shaping channels having substantially the same depth, width and pitch.

9. A rotary atomizer comprising:

a rotatable member having an inlet side adapted to receive material to be atomized and an outlet side adapted to output the material to be atomized; and a plurality of air shaping members on an exterior portion of said rotating member, wherein said shaping members comprise channels on an exterior surface of said rotatable member, wherein said channels have at least one of a depth, width, shape and pitch selected to produce a desired distribution of said atomized material, at last one of said channels having a different value of at least one of said depth, width and pitch from others of said channels.

10. A rotary atomizer system comprising:

a rotary atomizer;

a plurality of vanes positioned relative to said atomizer to generate a flow of shaping air when said rotary atomizer rotates, wherein said vanes rotate independently of the rotation of said rotary atomizer.

11. A rotary atomizer comprising:

a rotatable member having a cavity, a plurality of outlets communicating with the cavity, an exterior surface surrounding the cavity, and an outer edge adjacent to an end portion of the rotatable member where material to be atomized leaves the rotatable member; and a plurality of air-shaping members formed on the exterior surface of the rotatable member, wherein the air-shaping members extend to the outer edge of the rotatable member.

12. A rotary atomizer as recited in claim 11, wherein the air-shaping members comprise elongated channels.

13. A rotary atomizer as recited in claim 11, wherein the air-shaping members comprise blades extending outwardly from the exterior surface of the rotatable member.

14. A rotary atomizer as recited in claim 11, wherein the rotatable member is a bell cup having a substantially conical inner surface, and the exterior surface thereof is also conical.

15. A rotary atomizer as recited in claim 14, wherein the shaping members comprise blades extending outwardly from the exterior surface of the rotatable member.

16. A rotary atomizer as recited in claim 15, wherein the blades are shaped and positioned to produce a desired distribution of said atomized material.

17. A rotary atomizer as recited in claim 11, wherein the rotatable member distributes atomized material differently at different rotation speeds thereof.

18. A method of atomizing a material, comprising:

providing a rotatable member having a cavity, a plurality of outlets communicating with the cavity, an exterior surface surrounding the cavity, and an outer edge adjacent to an end portion of the rotatable member where material to be atomized leaves the rotatable member;

providing a plurality of air-shaping members formed on the exterior surface of the rotatable member, wherein the air-shaping members extend to the outer edge of the rotatable member;

feeding the material to be atomized through the outlets and rotating the rotatable member to a desired speed at which a desired pattern of the atomized material is emitted from the end portion of the rotatable member.

19. A method as recited in claim 18, wherein the air-shaping members comprise elongated channels.

20. A method as recited in claim 18, wherein the air-shaping members comprise blades extending outwardly from the exterior surface of the rotatable member.

* * * * *